US006043796A

United States Patent [19]

Shinkawa et al.

[11] Patent Number: 6,043,796

[45] Date of Patent: Mar. 28, 2000

[54] CLUTCH FOR MOTOR DRIVEN ANTENNA

[75] Inventors: Masaki Shinkawa, Yamato; Shinichi Saito, Tokyo, both of Japan

[73] Assignee: Harada Industry Co., Ltd., Tokyo, Japan

[21] Appl. No.: 09/083,292

[22] Filed: May 22, 1998

[30] Foreign Application Priority Data

May 23, 1997 [JP] Japan ..... 9-133577

[51] Int. Cl.[7] ..... H01Q 1/10; H01Q 1/32

[52] U.S. Cl. ..... 343/903; 343/711; 343/713; 343/715

[58] Field of Search ..... 343/711, 712, 343/713, 714, 715, 900, 901, 903

[56] References Cited

U.S. PATENT DOCUMENTS 5,068,673 11/1991 Kimura ..... 343/901
5,173,716 12/1992 Tetsuka ..... 343/903
5,959,593 9/1999 Hoshi ..... 343/903

*Primary Examiner*—Don Wong
*Assistant Examiner*—Jennifer H Malos
*Attorney, Agent, or Firm*—John P. White; Cooper & Dunham LLP

[57] ABSTRACT

A clutch for a motor driven antenna according to the present invention includes a driving member rotated by a driving motor, a driven member for transmitting a rotating force of the driving member to an antenna element, and a clutch element for frictionally transmitting the rotating force of the driving member to the driven member. The clutch element includes recesses formed on a rotating track of one of opposing sides of the driving member and driven member, projections formed on a rotating track of the other side so as to be fitted into the recesses when the driving member and the driven member are rotated relative to each other, and anti-slip members protruded near the recesses such that a sliding frictional force caused at the tip end contact portions of the projections exceeds a maximum load of the antenna element including the driven member when the antenna element is extended or retracted.

5 Claims, 5 Drawing Sheets

CLUTCH FOR MOTOR DRIVEN ANTENNA

BACKGROUND OF THE INVENTION

The present invention relates to a clutch adapted to a motor driven antenna for automobiles and, more specifically, to a clutch for a motor driven antenna which obtains a clutch force by an operation of fitting/separating a projection into/from a recess formed on the pressure surface of two rotating bodies.

In a conventional clutch of this type, when a power supply is turned on, a motor rotates forward or backward, while a driving clutch plate on the motor side rotates. Accordingly a driven clutch plate pressed on the driving clutch plate rotates. If the driven clutch plate rotates, its rotating force is transmitted to an antenna element through an antenna extending/retracting rope (e.g., a rope with a rack) to extend or retract the antenna element.

The angular displacement of recesses, which are formed at regular intervals along a rotating track on the pressure surface of the driving clutch plate, and that of projections (each elastically holding, e.g., fitting balls), which are also formed at regular intervals along a rotating track on the pressure surface of the driven clutch plate, are usually inconsistent with each other in the initial state. For this reason, if a sliding frictional force is varied between the driving and driven clutch plates due to a vibration caused during the extension and retraction of the antenna element or a load is changed due to variations in sliding frictional resistance of the antenna element, the projections of the driven clutch plate, which contact the inner surface of the driving clutch plate, slip and their contact positions are shifted. If the projections of the driven clutch plate drop into the recesses of the driving clutch plate, both the clutch plates are fitted into each other to generate a relatively loud noise.

When the extending or retracting operation of the antenna element is completed, the driven clutch plate coupled to the antenna element stops rotating, whereas the driving clutch plate continues to rotate as long as the motor rotates. The clutch is therefore disengaged, and the driving clutch plate and driven clutch plate slip relative to each other. A fitting/separating operation between the recesses and projections on the pressure surfaces of both the clutch plates, is repeated. Thus, the antenna element is completely extended, and a bad effect due to locking of the motor is avoided. In the meantime, a loud noise is continuously generated by the fitting/separating operation.

In the conventional clutch for a motor driven antenna, the projections of the driven clutch plate are dropped into the recesses of the driving clutch plate to generate a loud noise during the extending and retracting operations of the antenna element. This noise is relatively less than that continuously caused when the extending or retracting operation is finished. Since, however, the timing at which the loud noise is generated is irregular, the noise considerably offends a user's ear, and the user may think that any trouble has been caused in the antenna

BRIEF SUMMARY OF THE INVENTION

It is accordingly an object of the present invention to provide a clutch for a motor driven antenna which prevents a projection from dropping into a recess during the extending/retracting operation of an antenna element and thus generates no loud noise due to the extending/retracting operation.

To attain the above object, the clutch of the present invention has the following constructions.

The other characteristic constructions will be clarified in the embodiment

The clutch for a motor driven antenna comprises a disk-shaped driving member rotated by a rotating force of a driving motor, a disk-shaped driven member one side of which is opposite to one side of the driving member, for transmitting a rotating force of the driving member to an antenna element, and a clutch element interposed between both sides of the driving member and the driven member so as to frictionally transmit the rotating force of the driving member to the driven member.

The clutch element includes recesses formed on a rotating track of one of opposing sides of the driving member and the driven member, projections formed on a rotating track of other of the opposing side so as to be fitted into the recesses when the driving member and the driven member are rotated relative to each other, and anti-slip members protruded near the recesses such that a sliding frictional force caused at tip end contact portions of the projections exceeds a maximum load of the antenna element including the driven member when the antenna element is extended or retracted.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION (Embodiment)

Figure 1:
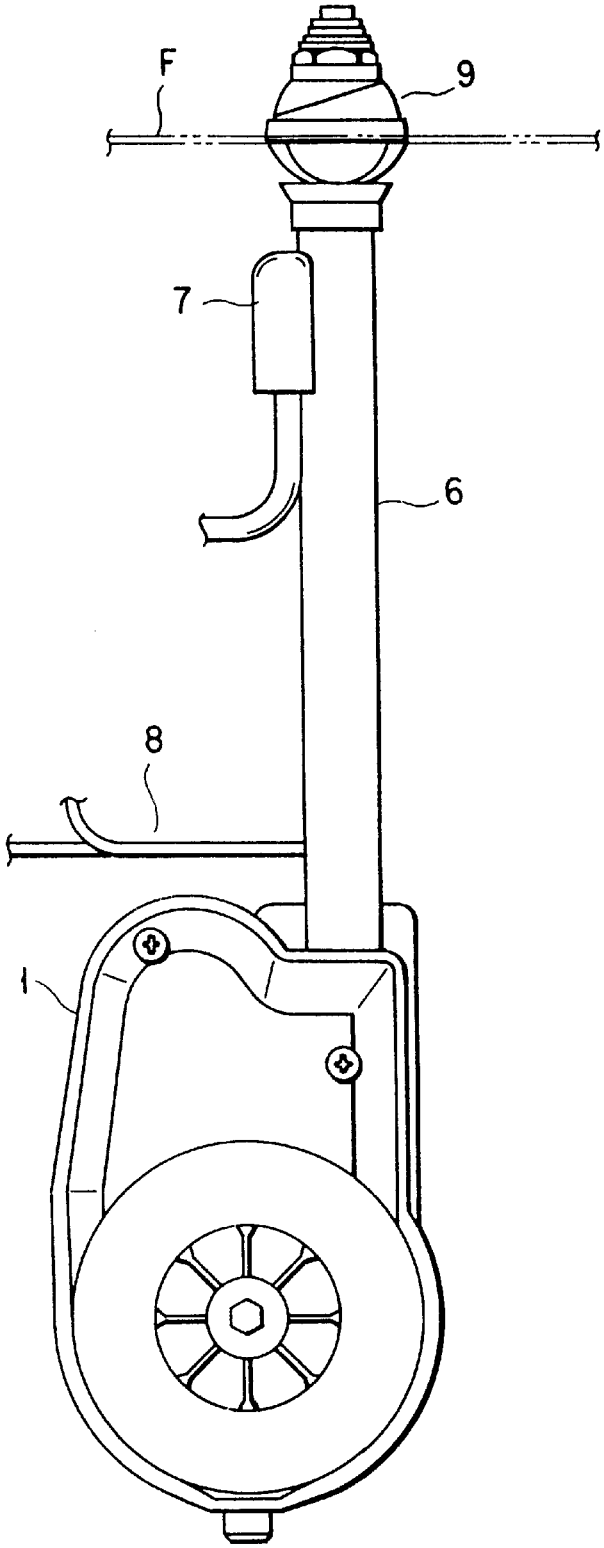
FIG. 1 is a front view schematically showing the construction of a motor driven antenna apparatus for automobiles which is mounted with a clutch according to an embodiment of the present invention.
Figure 2:
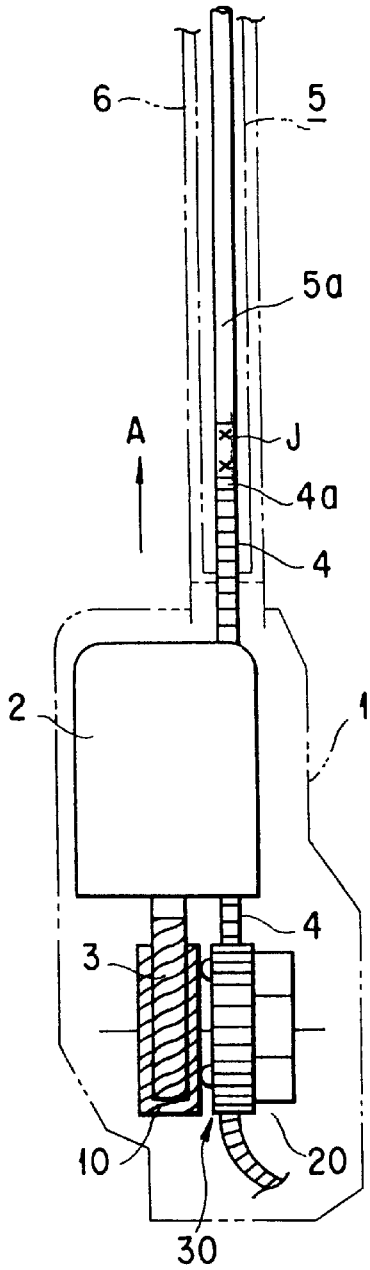
FIG. 2 is a side view of the major part of the motor driven antenna shown in FIG. 1.

FIGS. 1 and 2 illustrate a motor driven antenna apparatus for automobiles. The antenna apparatus includes a driving mechanism holding case 1, a driving motor 2, a worm gear 3, a rope 4 with a rack for extending and retracting an antenna element, a telescopic antenna element 5 constituted by slidably connecting a plurality of conductive pipes having different diameters, an antenna element holding tube 6, a feeder portion 7, a power cord 8, a mounting mechanism 9 for mounting the antenna apparatus on a car body F.

The antenna apparatus also includes a disk-shaped driving member 10, a disk-shaped driven member 20 and a clutch element 30.

In the motor driven antenna apparatus, the driving motor 2 is rotated forward or backward to automatically extend or retract the telescopic antenna element 5.

More specifically, if the driving motor 2 held in the case 1 is rotated forward, the rotating force of the motor 2 is transmitted to the driving member 10 via the worm gear 3; accordingly, the driving member 10 is rotated forward. The rotating force of the driving member 10 is frictionally transmitted to the driven member 20, through the clutch element (which will be described in detail).

If the driven member 20 is rotated forward, its rotating force is transmitted to the rope 4 with a rack through a pinion formed on the periphery of the driven member 20. The rope 4 is thus sent out in the direction of arrow A in FIG. 2, and the smallest-diameter rod 5*a* of the antenna element 5, whose distal end portion is coupled to the tip end 4*a* of the rope 4 through a joint J, is pushed out of the holding tube 6. The other rods of the antenna element 5 are pushed out in sequence, and the element 5 is extended.

If the antenna element 5 is extended, the driven member 20 cannot be rotated any more and thus stops rotating, whereas the driving member 10 continues to rotate since it continuously receives a rotating force from the driving motor 2. As a result, the clutch element 30 between the driving and driven members 10 and 20 is turned off, and the driving member 10 spins. Since the rope 4 continuously receives the force by which it is sent out in the direction of arrow A, the antenna element 5 is extended sufficiently. After that, the power of the driving motor 2 is cut off.

If the driving motor 2 is rotated backward, an operation opposite to the above is performed, and the antenna element 5 is retracted. Thus, the driven member 20 stops rotating, whereas the driving member 10 continues to rotate as it does and the clutch element 30 is turned off. After that, the power of the driving motor 2 is cut off.

Figure 3:
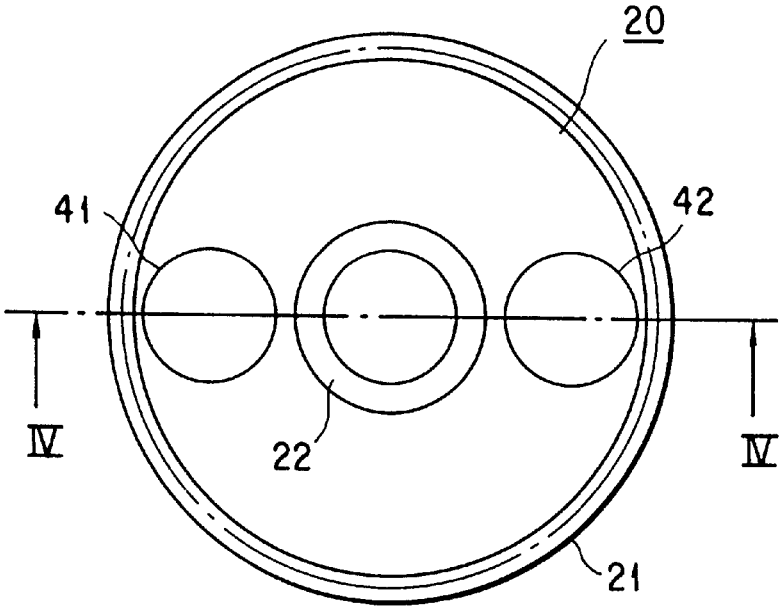
FIG. 3 is a front view illustrating the constitution of the entire clutch according to the embodiment of the present invention.
Figure 4:
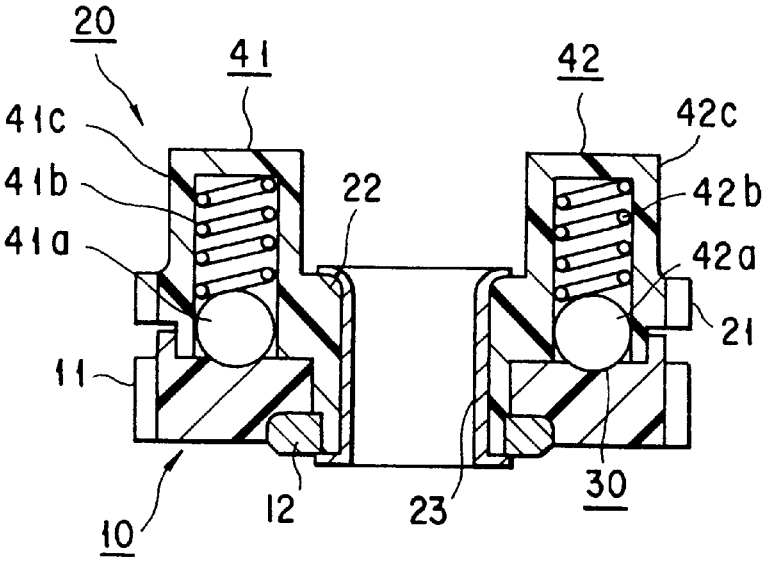
FIG. 4 is a cross-sectional view taken along line IV—IV of FIG. 3.

As illustrated in FIGS. 3 and 4, the clutch of this embodiment includes the driving member 10, driven member 20 and clutch element 30. The clutch element 30 is interposed between the opposing sides of the members 10 and 20 so as to frictionally transmit the rotating force of the driving member 10 to the driven member 20.

Figure 5:
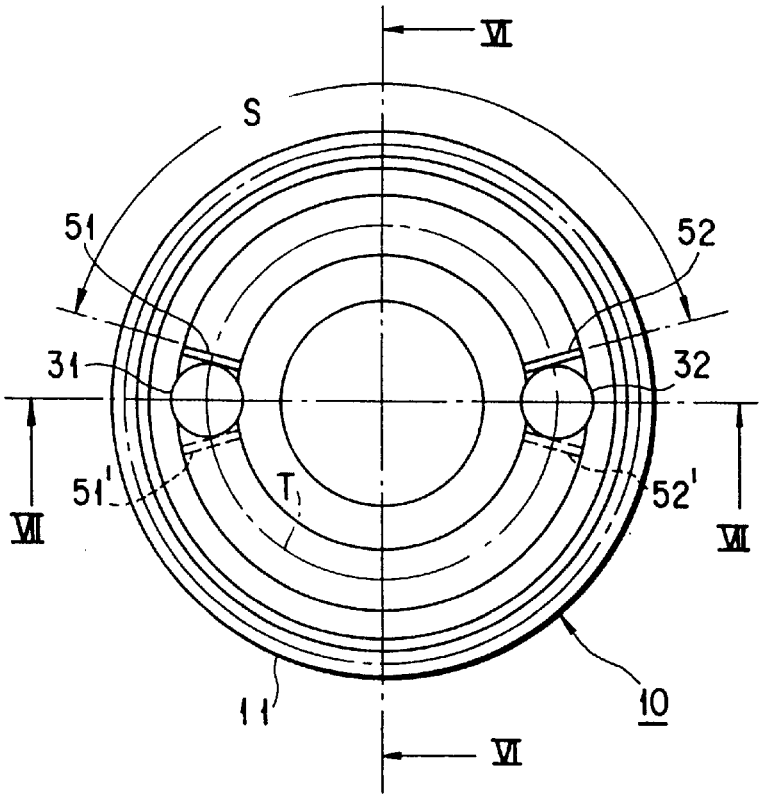
FIG. 5 is a plan view of the constitution of a driving member of the clutch of the embodiment of the present invention.
Figure 6:
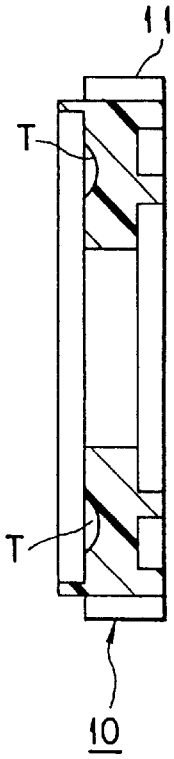
FIG. 6 is a cross-sectional view taken along line VI—VI of FIG. 5.
Figure 7:
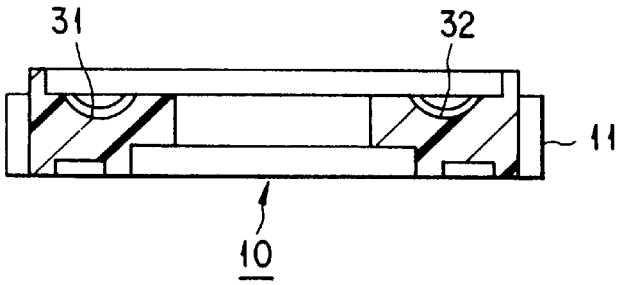
FIG. 7 is a cross-sectional view taken along line VII—VII of FIG. 5.

Referring to FIGS. 5 to 7, the driving member 10 is formed by, e.g., synthetic resin and shaped like a disk, and a worm wheel 11, which is engaged with the worm gear 3, is formed on the periphery of the member 10. Thus, the driving member 10 is rotated by the rotating force of the driving motor 2.

Returning to FIGS. 3 and 4, the driven member 20 is formed by, e.g., synthetic resin and shaped like a disk, and a pinion 21, which is engaged with the rack of the rope 4, is formed on the periphery of the member 20. The member 20 is so arranged that one side thereof is opposed to one side of the driving member 10 (both sides contact each other in FIG. 4), and the rotating force of the driving member 10 is transmitted to the rope 4 by the pinion 21.

The driven member 20 has an axial tube section 22 in its center, and the axial tube section 22 is unrotatively fitted into a metal cylindrical collar 23 serving as a an axial tube of the whole clutch. The central part of the driving member 10 is rotatably fitted on the periphery of the axial tube section 22 and engaged therewith by a washer 12 so as not to be separated from the section 22.

The constitution of the clutch element 30 will now be described.

As illustrated in FIGS. 3 to 7, a plurality of (two in this embodiment) spherical recesses 31 and 32 are formed at regular intervals (180° in this embodiment) on the rotating track T (corresponding to a shallow, spherical groove as shown) on one side of the driving member 10. When the driving and driven members 10 and 20 are rotated relative to each other, a plurality of (two in this embodiment) projections 41 and 42, which are provided on the rotating track of one side of the driven member 20, are fitted into the recesses 31 and 32.

As shown in FIG. 4, the projections 41 and 42 include steel balls 41*a* and 42*a*, compressed coil springs 41*b* and 42*b*, and holding tubes 41*c* and 42*c*, respectively.

Referring to FIG. 5, paired protruded anti-slip members 51 and 52 are provided in the vicinity of the recesses 31 and 32, respectively. The anti-slip members 51 and 52 supply a predetermined movement blocking force to the projections 41 and 42 in such a manner that the sliding frictional force caused at the tip end contact portions of the projections 41 and 42 exceeds the maximum load of the antenna element 15 including the driven member 20 in the extending or retracting operation of the antenna element 15 or the projections 41 and 42 do not easily move on the rotating track T.

The anti-slip members 51 and 52 are arranged opposite to each other with a given interval S on the rotating track T between the adjacent recesses 31 and 32. The interval between the anti-slip member 51 and recess 31 or between the anti-slip member 52 and recess 32 is set as illustrated in FIG. 8.

Figure 8:
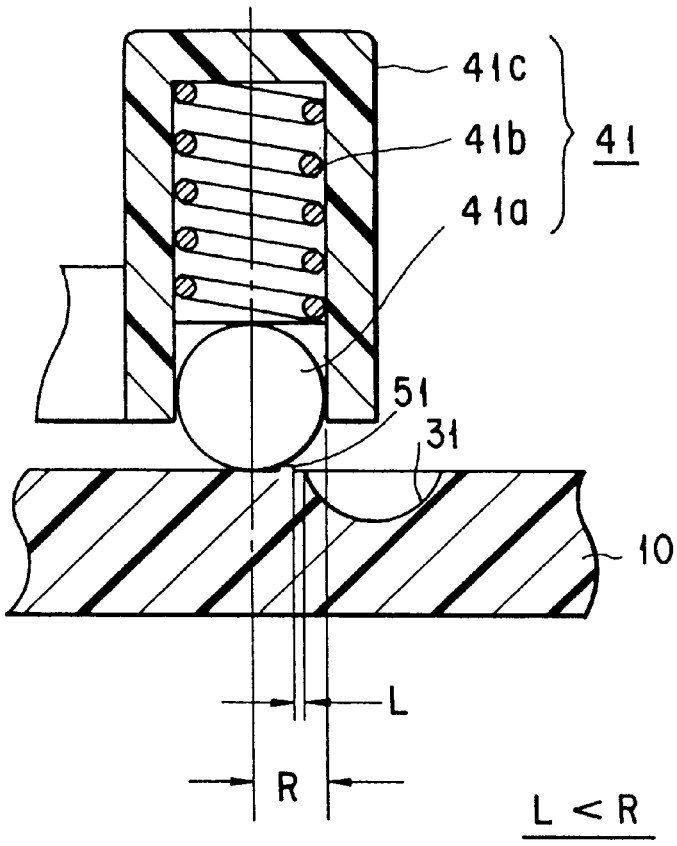
FIG. 8 is a view of the constitution of an anti-slip member of the clutch of the embodiment of the present invention, showing a relationship between a recess and a projection.
Figure 9:
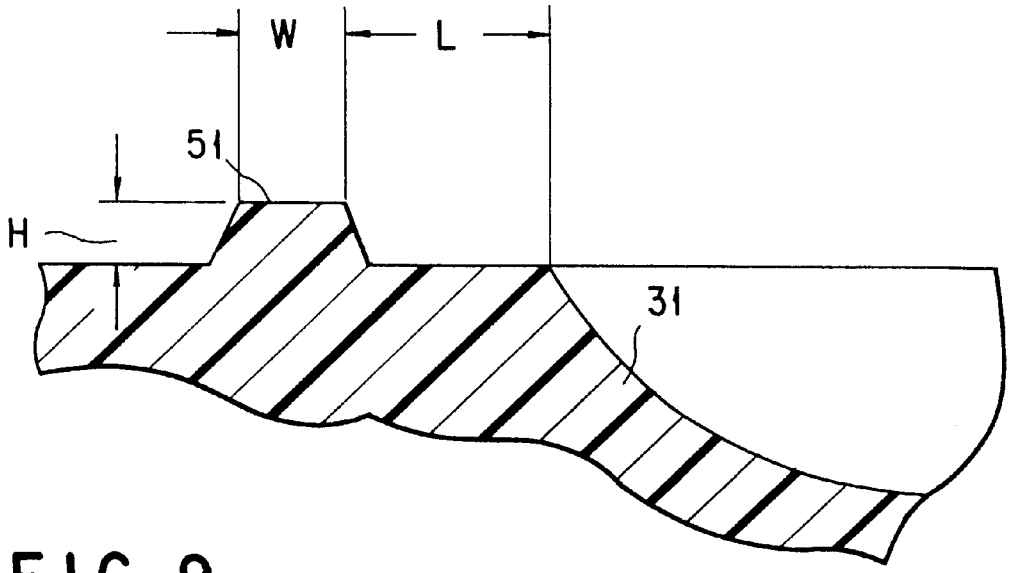
FIG. 9 is a cross-sectional view of the major part of the anti-slip member shown in FIG. 8.

FIGS. 8 and 9 show the relationship between the anti-slip member 51 and its peripheral portions. However, in these figures, only the relationship among the recess 31, projection 41 and anti-slip member 51 is shown. The interval L between the anti-slip member 51 and recess 31 is set not larger than the radius R of the steel ball 41*a* of the projection 41 fitted into the recess 31.

As a result of experiments on the trial product, it has turned out that it is desirable that when the radius R of the steel ball 41*a* is 3 mm, the interval L be 1 mm or small and the upper width W and height H of the protrusion constituting the anti-slip member 51 be about 0.5 mm and 0.3 mm, respectively. However, they are not be always limited to these values.

The clutch for a motor driven antenna so constituted is operated as follows. If the driving motor 2 is rotate forward or backward to extend or retract the antenna element 5, the driving member 10 is rotated forward or backward. Thus, the rotating force of the driving member 10 is frictionally transmitted to the driven member 20 through the clutch element 30, and the driven member 20 is also rotated forward or backward.

When the antenna element 5 starts to extend or retract, the angular displacement of the projections 41 and 42 and that of recesses 31 and 32 are usually inconsistent with each other. During the extending or retracting operation of the antenna element 5, if there occurs a variation in pressing force between both the members 10 and 20 or a variation in sliding frictional force caused in the tip end contact portions of the projections 41 and 42, a variation in load of the antenna element 5 including a change in sliding frictional resistance of the antenna element 5, etc., a slip may occur between the members 10 and 20. Thus, the positions between the projections 41 and 42 and the recesses 31 and 32 are shifted and in other words the projections 41 and 42 are moved relative to each other on the rotating track T.

According to the foregoing embodiment of the present invention, since the paired anti-slip members 51 and 52 are protruded near the recesses 31 and 32 on the rotating track T, the above relative movement of the projections 41 and 42 are restricted. In other words, even though the projections 41 and 42 are moved relative to each other on the rotating track T to approach the recesses 31 and 32, they are stopped at the positions of the anti-slip members 51 and 52 and not moved any more. Therefore, the projections 41 and 42 are prevented from dropping into the recesses 31 and 32, and no loud noise is generated.

Figure 10:
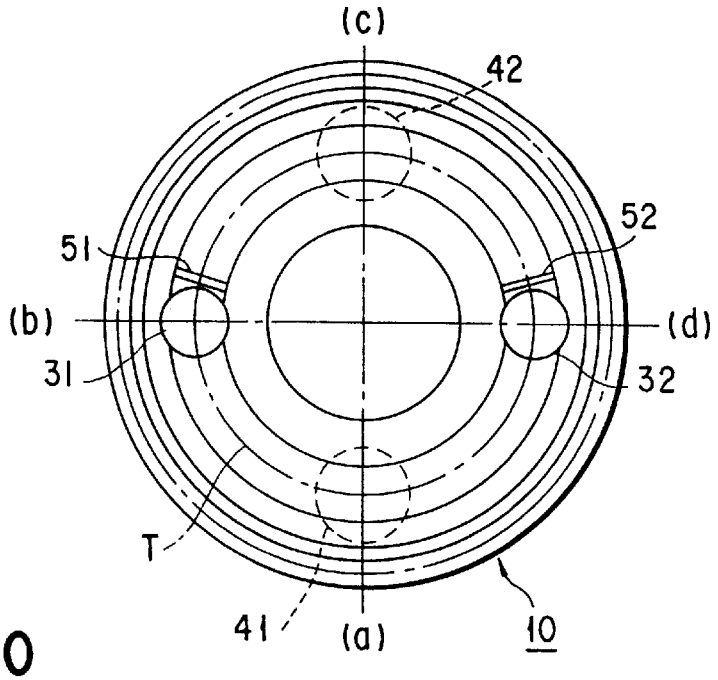
FIG. 10 is a plan view of the driving member for explaining an operation of the clutch of the embodiment of the present invention.
Figure 11:
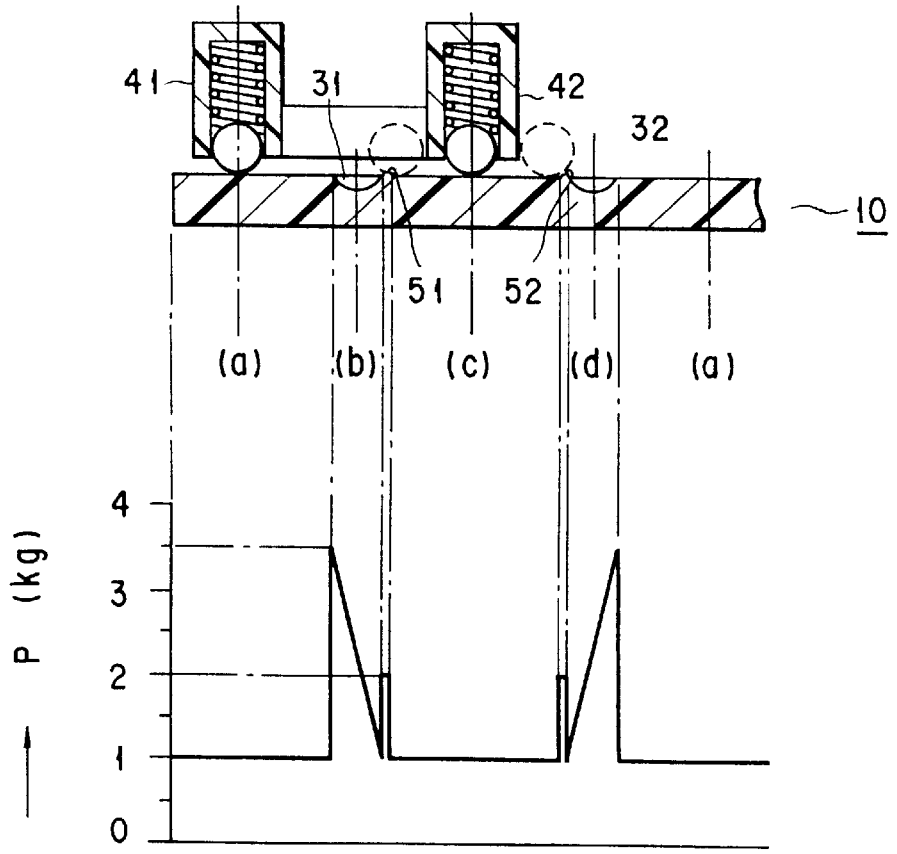
FIG. 11 is a view for explaining an operation of the clutch of the embodiment of the present invention and showing the driving member rotated in its circumferential direction and the characteristics of variations in operating force corresponding to the rotation of the driving member.

FIGS. 10 and 11 are views for explaining an operation of the clutch of the present invention. As shown, when the antenna element 5 is extended, the movement of the projection 42 located at (c) is stopped by the anti-slip member 52 arranged close to the recess 32 located at (d). When the antenna element 5 is retracted, the movement of the projection 42 located at (c) is stopped by the anti-slip member 51 arranged close to the recess 31 located at (b).

As illustrated in FIG. 11, the operating force P of the projections 41 and 42, which is required when they slide along the rotating track T on the surface of the driving member 10, is about 1 kg, that at the positions of anti-slip members 51 and 52 is about 2 kg, and that at the positions of recesses 31 and 32 is about 3.5 kg.

(Modifications)

The clutch for a motor driven antenna according to the embodiment of the present invention, can be modified as follows:

i) Two anti-slip members (e.g., 51, 51') are arranged before and after one recess (e.g., 31, 31') on the rotating track T.

ii) The anti-slip members are constituted of a plurality of dot-like protrusions.

iii) The projections are formed by materials having lubrication such that their ends are spherical.

(Merits of the Embodiment and Modifications)

The clutch for a motor driven antenna according to the embodiment and modifications has the following structures and advantages.

[1] A clutch for a motor driven antenna comprises a disk-shaped driving member 10 rotated by a rotating force of a driving motor 2, a disk-shaped driven member 20 one side of which is opposite to one side of the driving member 10, for transmitting a rotating force of the driving member 10 to an antenna element 5, and a clutch element 30 interposed between both sides of the driving member 10 and the driven member 20 so as to frictionally transmit the rotating force of the driving member 10 to the driven member 20.

The clutch element 30 is characterized by including recesses 31 and 32 formed on a rotating track T of one of the opposing sides (one side of the member 10 in this embodiment), projections 41 and 42 formed on a rotating track of the other side (one side of the member 20 in this embodiment) such that they are fitted into the recesses 31 and 32 when the driving member 10 and the driven member 20 are rotated relative to each other, and anti-slip members 51 and 52 protruded near the recesses 31 and 32 such that the sliding frictional force caused at tip end contact portions of the projections 41 and 42 exceeds the maximum load of the antenna element 5 including the driven member 20 when the antenna element 5 is extended or retracted.

In the foregoing clutch, since the anti-slip members 51 and 52 are protruded from the rotating track T on one side of the member (e.g., 10) in which the recesses 31 and 32 are formed, a slip is caused between the driving and driven members 10 and 20 due to a vibration of both the members 10 and 20 and an influence of variations in load of the antenna element 5 when the antenna element 5 is extended or retracted. Even when the positions of the recesses 31 and 32 and the projections 41 and 42 are shifted from each other, the movement of the projections 41 or 42 (e.g., 42) is stopped by the anti-slip members 51 and 52.

Consequently, the projections 41 and 42 are not dropped into the recesses 31 and 32 to prevent a loud noise from being generated. Since the above slip is caused when the above sliding frictional force of the projections 41 and 42 is lower than the load of the antenna element 5 including the driven member 20, the movement of the projections 41 and 42 is blocked if the movement blocking force of the anti-slip members 51 and 52 is added such that the sliding frictional force always exceeds the maximum load of the antenna element 5 including the driven member 20. When the extending or retracting operation of the antenna element 5 is completed, the fitting/separating operation between the projections 41 and 42 and the recesses 31 and 32 need to be repeated smoothly. It is thus desirable that the anti-slip members 51 and 52 have such a movement blocking force that the sliding frictional force caused at the tip end contact portions of the projections 41 and 42 slightly exceeds the maximum load of the antenna element 5 including the driven member 20 when the antenna element 5 is extended or retracted.

[2] In the clutch for a motor driven antenna as described in above [1], the anti-slip members 51 and 52 are opposed to each other on a rotating track T connecting adjacent two recesses 31 and 32, with a given interval therebetween.

When the projections 41 or 42 (e.g., 42) located halfway between the recesses 31 and 32 is moved in either direction by the rotation of the driving member 10, its movement is prevented by its corresponding one of the anti-slip members 51 and 52. Thus, in both cases where the antenna element 5 is extended and retracted, the projections are not dropped into the recesses 31 and 32 to prevent a loud noise from being generated.

[3] In the clutch for a motor driven antenna as described in above [1], the anti-slip members 51 and 52 are each spaced away from an edge of each of the recesses 31 and 32 with an interval L not greater than such an interval that the tip end contact portions of the projections 41 or 42 (e.g., 42) contact and stand still.

In the foregoing clutch, the projections 41 or 42 (e.g., 42) cannot be stably held so as to contact and stand still between the anti-slip member 51 and the recess 31 or the anti-slip member 52 and the recess 32. For this reason, the projections 41 or 42 (e.g., 42) are located between the anti-slip members 51 and 52 or dropped into the recesses 31 or 32 in advance when they start to operate. Therefore, when the antenna element 5 is extended or retracted, the projections 41 and 42 are not dropped into the recesses 31 and 32 to avoid generating a loud noise.

[4] In the clutch for a motor driven antenna as described above [1], when the radius of each of the projections 41 or

42 (e.g., 42) having a projected spherical surface is R, an interval between each of the anti-slip members 51 and 52 and an edge of each of the recesses 31 and 32 having a recessed spherical surface is set not larger than R.

This clutch has the same advantage as that of the clutch described in above [3].

[5] In the clutch for a motor driven antenna as described above [1], one pair of anti-slip members are provided before and after at least one of the recesses 31 and 32 on the rotating track thereof.

Even when each of the projections 41 and 42 arranged halfway between the recesses 31 and 32 is moved in either direction by the rotation of the driving member 10, its movement is stopped by one pair of anti-slip members. Thus, even in both cases where the antenna element 5 is extended and retracted, the projections 41 and 42 are not dropped into the recesses 31 and 32 to reliably prevent a loud noise from being generated.

[6] A clutch for a motor driven antenna is obtained by properly combining the clutches described above [1] to [5] and adding the above modifications thereto.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A clutch for a motor driven antenna comprising:

a disk-shaped driving member rotated by a rotating force of a driving motor;

a disk-shaped driven member one side of which is opposite to one side of the driving member, for transmitting a rotating force of the driving member to an antenna element; and a clutch element interposed between both sides of the driving member and the driven member so as to frictionally transmit the rotating force of the driving member to the driven member, the clutch element including:

recesses formed on a rotating track of one of opposing sides of the driving member and the driven member;

projections formed on a rotating track of other of the opposing side so as to be fitted into the recesses when the driving member and the driven member are rotated relative to each other; and anti-slip members protruded near the recesses such that a sliding frictional force caused at tip end contact portions of the projections exceeds a maximum load of the antenna element including the driven member when the antenna element is extended or retracted.

2. The clutch according to claim 1, wherein the anti-slip members are opposed to each other on a rotating track connecting adjacent two recesses, with a given interval therebetween.

3. The clutch according to claim 1, wherein the anti-slip members are each spaced away from an edge of each of the recesses with an interval not greater than such an interval that the tip end contact portions of the projections contact and stand still.

4. The clutch according to claim 1, wherein when a radius of each of the projections is R, an interval between each of the anti-slip members and an edge of each of the recesses is set not larger than R.

5. The clutch according to claim 1, wherein one pair of anti-slip members are provided before and after at least one of the recesses on the rotating track thereof.

* * * * *